US005803203A

United States Patent [19]

Williams, II

[11] Patent Number: 5,803,203

[45] Date of Patent: Sep. 8, 1998

[54] ACTIVE SCAFFOLDING SYSTEMS

[75] Inventor: Robert L. Williams, II, Athens, Ohio

[73] Assignee: Ohio University, Athens, Ohio

[21] Appl. No.: 856,329

[22] Filed: May 14, 1997

Related U.S. Application Data

[60] Provisional application No. 60/017,393 May 14, 1996.

[51] Int. Cl. [6] ..... E04G 1/20

[52] U.S. Cl. ..... 182/141; 182/19; 182/128

[58] Field of Search ..... 182/141, 179.1, 182/128, 69.5, 19, 18, 148, 152

[56] References Cited

U.S. PATENT DOCUMENTS 5,555,952 9/1996 Van Mol ..... 182/141

*Primary Examiner*—Alvin C. Chin-Shue

*Attorney, Agent, or Firm*—Standley & Gilcrest

[57] ABSTRACT

The invention consists of an active scaffolding system adapted to hold a payload, said active scaffolding system comprising: (a) a plurality of adjustable links and rigid links connected by joints; (b) a plurality of actuator devices associated with the adjustable links so as to change to length of the adjustable links; (c) a microprocessor to determine how the lengths of each of the adjustable links throughout a number of time steps; the microprocessor being provided with computer program instructions to resolve the Cartesian end point translational and rotational motions; and (d) the adjustable links, rigid links, and actuator devices forming an active scaffolding adapted to move a payload around environmental obstacles while supporting said payload against the force of gravity.

1 Claim, 13 Drawing Sheets

12-dof Active Structure

VGT MODULE
PRIOR ART

WASTE STORAGE TANK VGT
PRIOR ART

HEAVY-DUTY HUMAN LIFTS
PRIOR ART

LIGHT-DUTY HUMAN LIFTS
PRIOR ART

ACTIVE SCAFFOLDING RETRACTED

ACTIVE SCAFFOLDING DEPLOYED

Longeron-Actuated Module (LAM)

Batten-Actuated Module (BAM)

Active Scaffolding Basket with Cartesian Coordinates

Longeron-Actuated Module with Virtual Serial Model 12-dof Active Structure

Virtual Serial Model

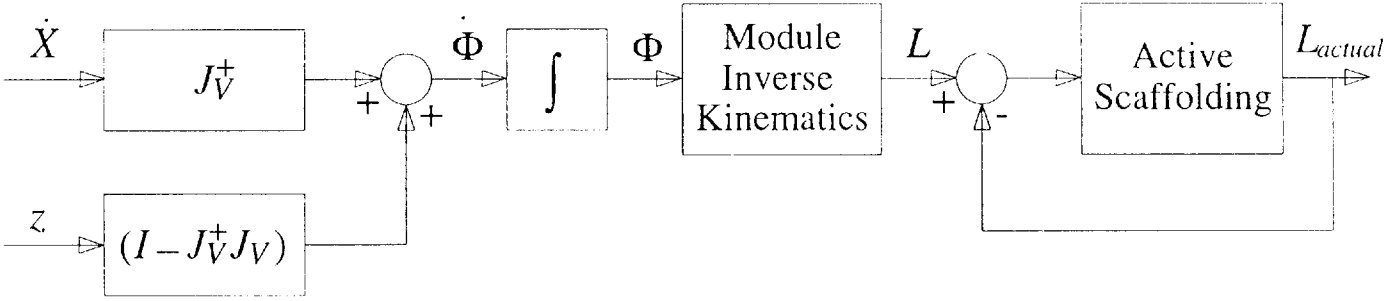
*Figure 12. Proposed Active Scaffolding Controller*

ACTIVE SCAFFOLDING SYSTEMS

This application claims the benefit of U.S. Provisional Application Serial No. 60/017,393 filed on May 14, 1996.

OBJECTIVES AND SIGNIFICANCE OF THE PRESENT INVENTION

The primary objective of the present invention is the publication of dexterous active scaffolding systems for the construction industry and for industrial maintenance. Such systems would carry workers, tools, and materials automatically to and from a fixed base in cluttered environments. This is an innovative adaptation and application of variable geometry truss technology (developed for space and nuclear applications) to serve as human lifts and work platforms for earth-based construction and industrial applications. The active scaffolding system must be stiff, strong, lightweight, safe, stable, and have a large range of motion. To satisfy these competing requirements, the present invention is proposed to produce a general design tool for integrated kinematics, dynamics, structural optimization, and control synthesis for the proposed active, articulating scaffolding structures. The proposed invention combines theoretical mathematical developments of an integrated computer-based design tool, with computer simulation and physical experimentation of the results.

The potential applications of active scaffolding systems of the invention are numerous, ranging from heavy construction and industrial maintenance to home construction and maintenance to active structures such as deployable bridges and antennae.

BRIEF DESCRIPTION OF THE DRAWINGS

FIG. 12 shows the controller of the novel Virtual Serial Manipulator Approach summarized in the proposed controller framework.

RELATION OF THE PRESENT INVENTION TO THE CURRENT STATE OF KNOWLEDGE IN THE FIELD

The proposed active scaffolding is believed novel, having no antecedent in the scientific literature to report. The present invention involves variable geometry trusses (VGTs). VGTs are truss structures designed so some of the struts are extensible, which enables the structure to articulate. VGTs can be designed to be dexterous, modular, lightweight, stiff, and capable of high payloads. One module which has received considerable attention is the double octahedral VGT shown in FIG. 1.

Figure 2:
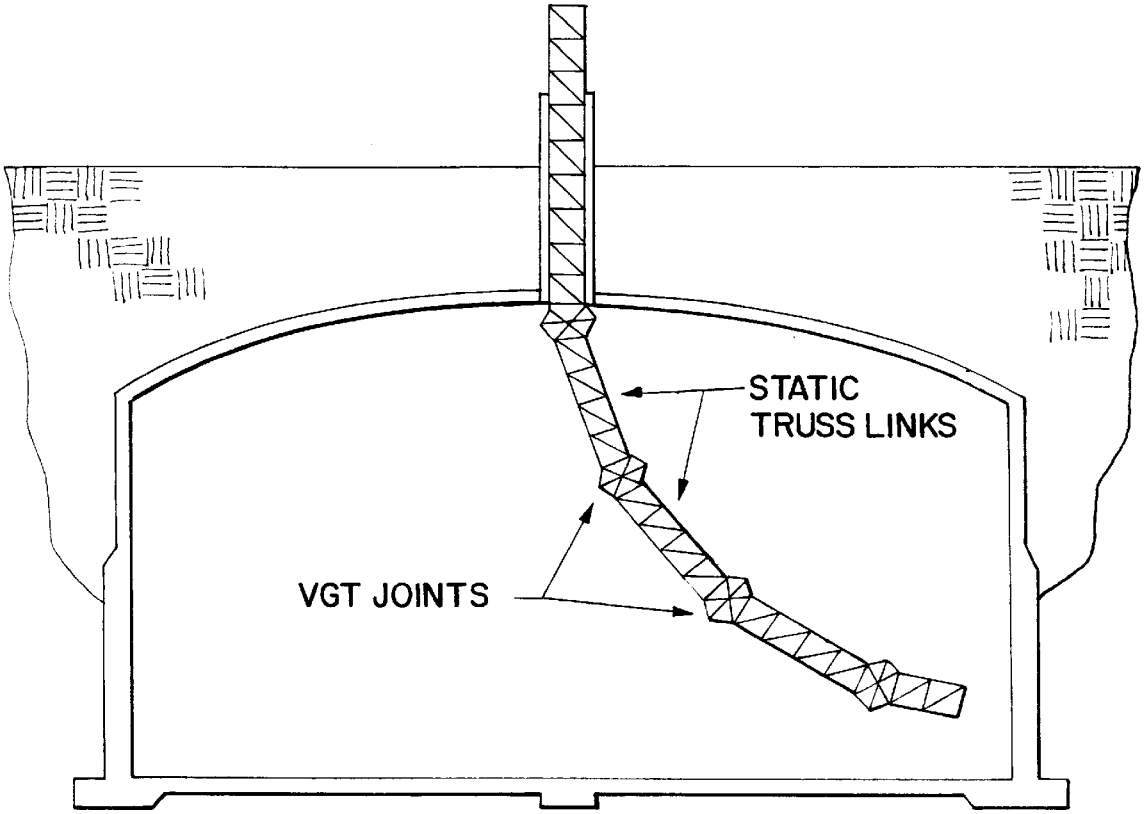
FIG. 2 shows a VGT-based active manipulator for cleaning nuclear waste from underground storage tanks.

This VGT module has three, degrees-of-freedom; the three struts on the mid-plane are all extensible actuators. This device was originally developed for constructing modular, deployable space structures. A second group of researchers studied use of this module for active vibration damping of deployable space structures. The third use for this technology is as an active structure, a large, light, and strong manipulator for various tasks. For example, a VGT-based active manipulator could be used to clean nuclear waste from underground storage tanks, as shown in FIG. 2. Numerous researchers have contributed to the VGT literature for space applications, nuclear applications, and general theory. These authors all present kinematic equations for control of VGTS. Structural design of active structures is presented in, where realistic joint modeling is included. Joint design for three dimensional VGTs is complex.

The present invention is a fourth paradigm for active structures, the active scaffolding concept. The innovation of the present invention allows human workers rather than tooling to be mounted on the end. Technology born in the space and nuclear arenas is applied and adapted to the construction and manufacturing industries. To date, the prior art has focused on individual aspects of VGT technology, usually kinematics. Safe and stable active scaffolding systems requires basic research into integrated kinematics, dynamics, structural, and control synthesis.

SUMMARY OF THE PRESENT INVENTION

Figure 3:
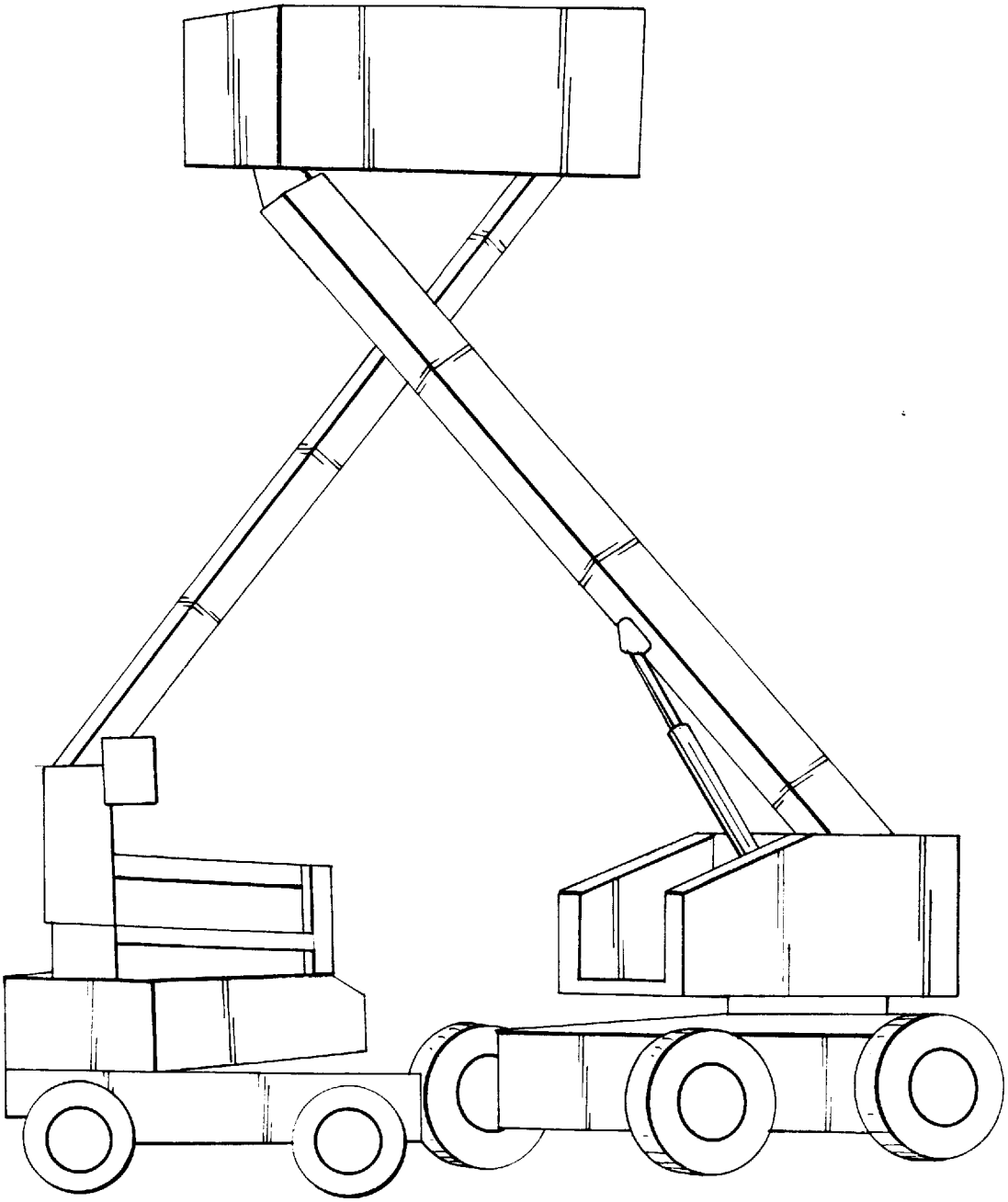
FIG. 3 shows a commercially available human lift.
Figure 4:
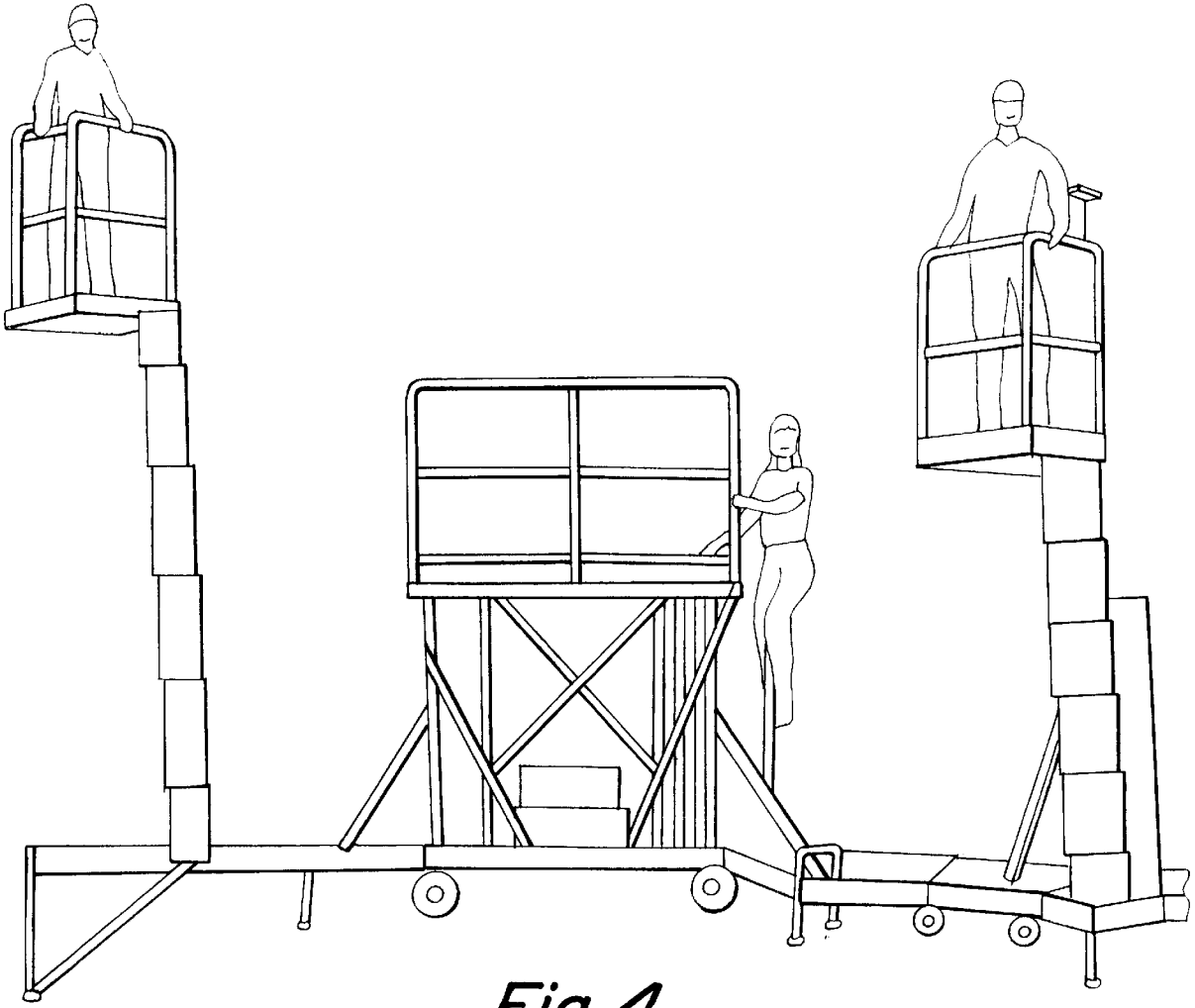
FIG. 4 shows another commercially available human lift.

There are a variety of applications in the construction and manufacturing industries which require a safe, stable work platform for humans. Currently, these needs are being met by static scaffoldings and human lifts. Static scaffoldings are designed to be stiff, strong, and lightweight. However, static scaffoldings must be built in place for each new job and they are not adaptable for extended reach. Commercially-available human lifts come in two basic options, shown in FIGS. 3 and 4. FIG. 3 shows heavy-duty human lifts similar to cherrypickers. These are strong (but not extremely stiff and are suited for working outdoors where limited dexterity is required. Indoor applications are limited to high-bay buildings with few obstacles and good ventilation. FIG. 4 shows light-duty human lifts which retract compactly and extend in only one direction, vertically. If the workers need to reach beyond the current basket location, the device must be retracted, the base outriggers released, the base repositioned, the outriggers reset, and the basket re-extended.

Figure 5A:
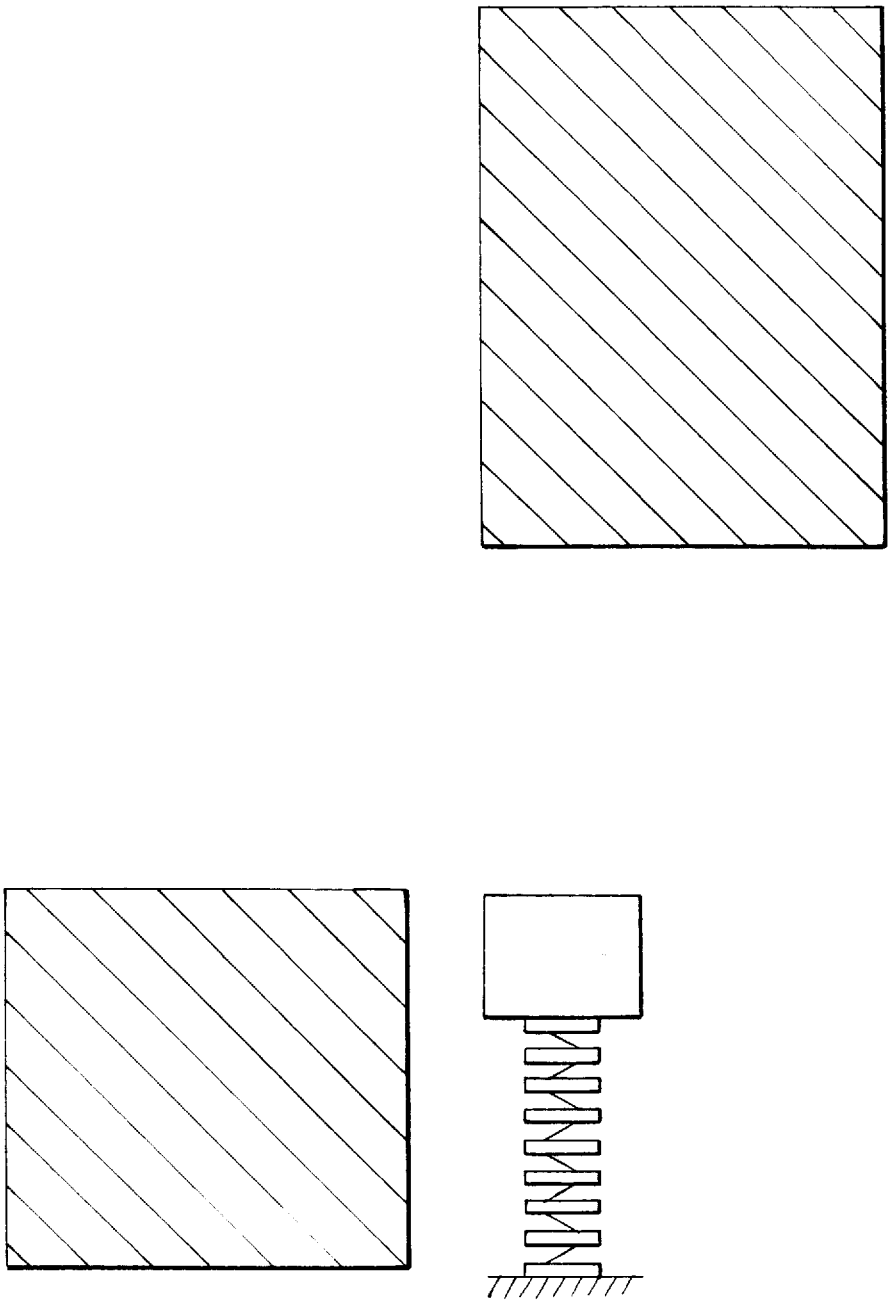
FIG. 5*a* shows the active scaffolding of the present invention in retracted position.

The present invention includes a novel type of structural system which combines the best features of the FIGS. 3 and 4 devices and increases the working volume for the platform in a cluttered environment, without repositioning the base. Characteristics of the proposed active scaffolding system include modularity, compactness when retracted, and dexterity to reach a large three-dimensional work area while avoiding collisions with the environment. The structural system -must be lightweight, stiff, capable of high payload, stable and safe. The system of the present invention will be controlled in two possible ways: 1) automatic computer control in Cartesian space with preplanned obstacle-free trajectories; and 2) joystick control from the human workers, where inputs are in Cartesian space and obstacle avoidance is "transparent" to the operators. The active scaffolding concept is shown retracted FIG. 5*a* and deployed in FIG. 5*b*.

Figure 6:
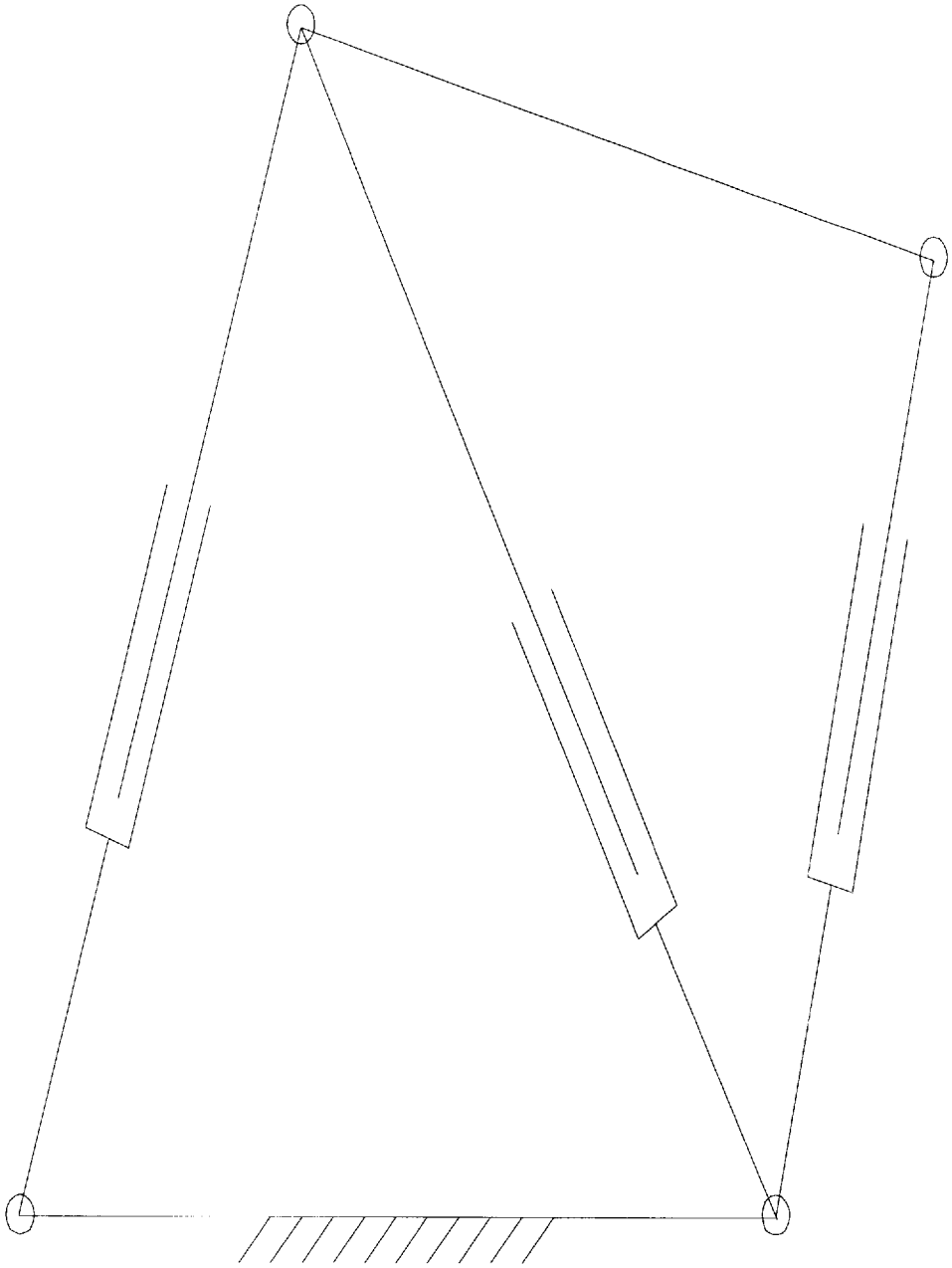
FIG. 6 shows a longeron-actuated module (LAM) of the present invention.
Figure 7:
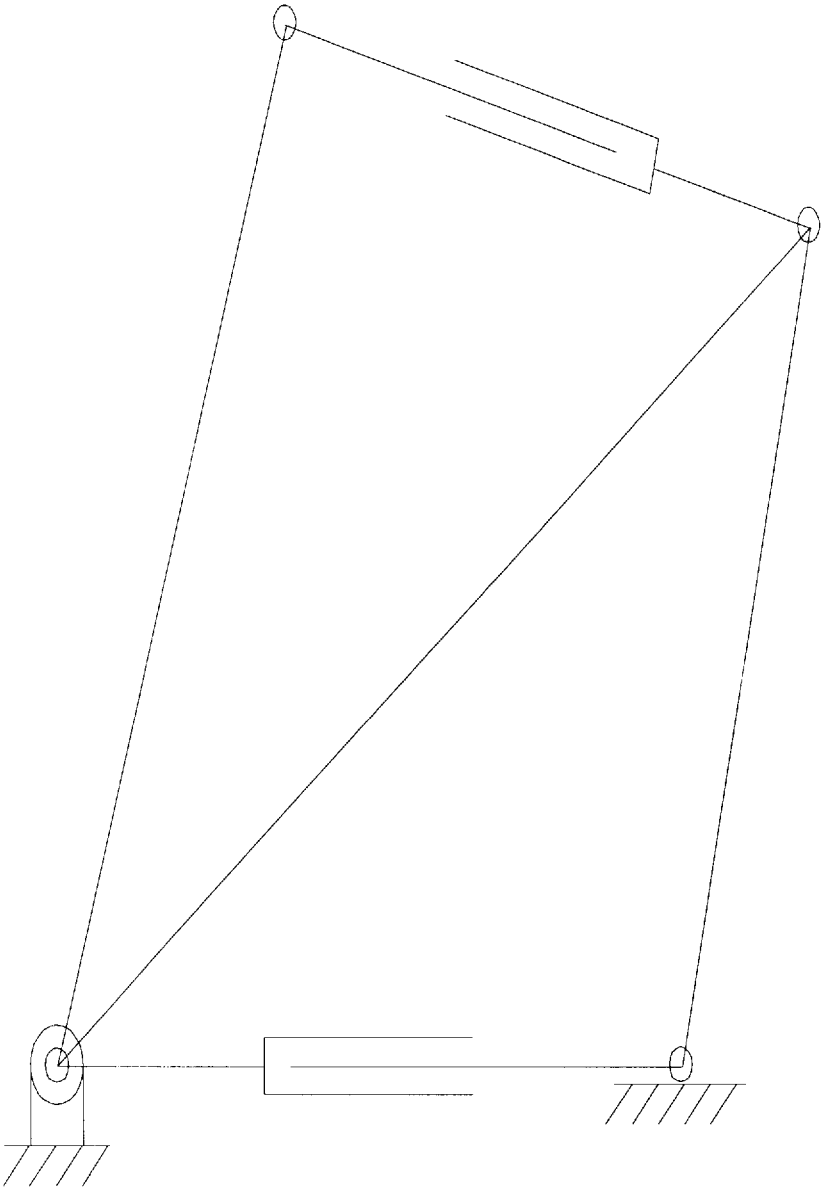
FIG. 7 shows a batten-actuated module (BAM) of the present invention.

In FIG. 5, each module has active elements that extend or retract individual struts, enabling the structure to articulate. The VGT module of FIG. 1 could be used in the active scaffolding system of the present invention. However, that module is kinematically complex and the passive joint design is complex which limits the structural stiffness. From that work, the best two module candidates are shown in FIGS. 6 and 7. Both are planar modules with extensible links, simple revolute passive joints, and straight-forward planar motion. Three-dimensional motions may be achieved by combining modules in perpendicular planes. The module in FIG. 7 is preferred for the active scaffolding because it retracts very compactly. The right connection to ground in FIG. 7 allows sliding along the ground link.

Figure 8:
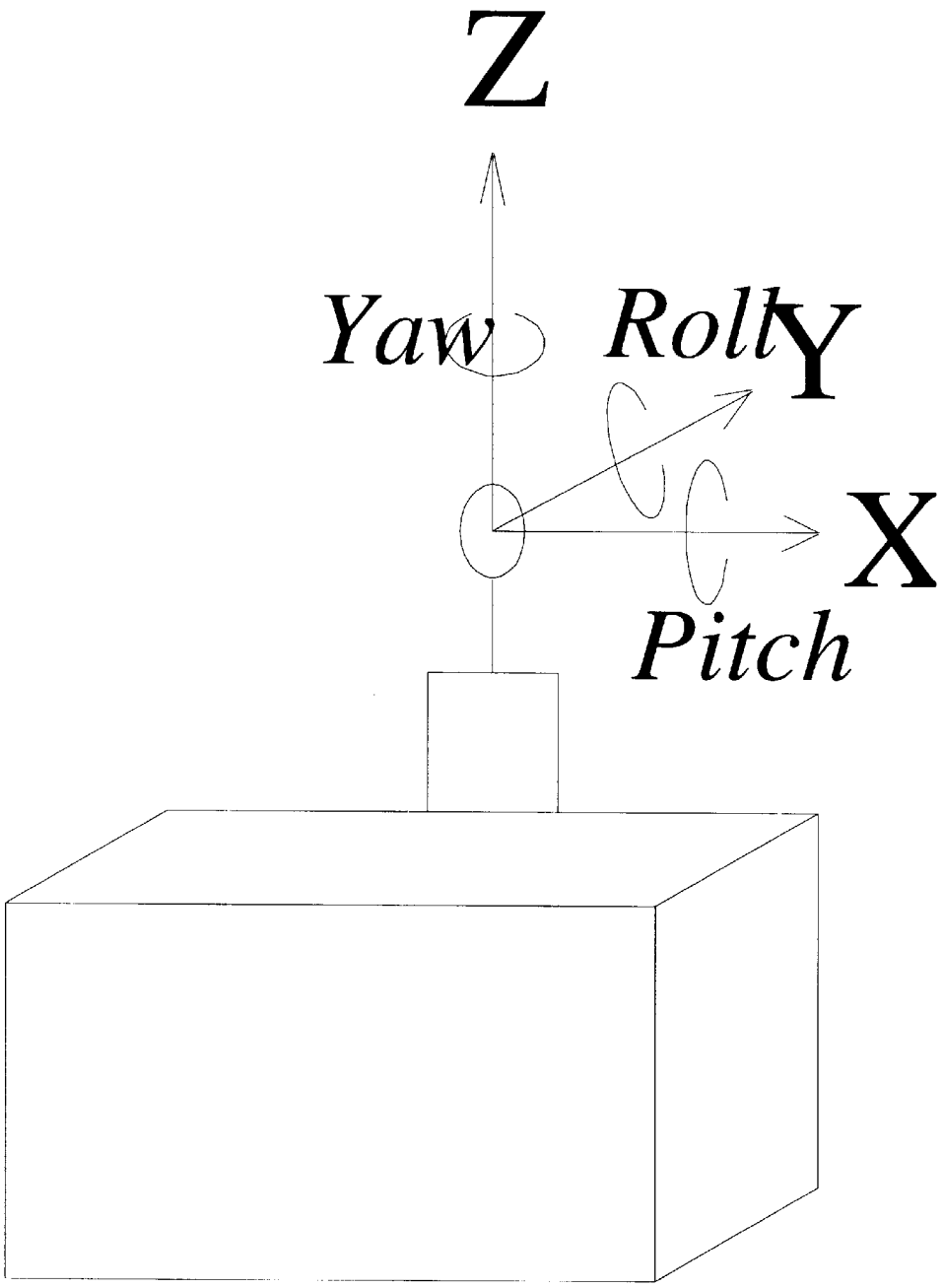
FIG. 8 shows the basket for transporting human workers, equipment, and materials to and from worksites.

FIG. 8 shows the basket for transporting human workers, equipment, and materials to and from worksites. In both control modes, automatic and joystick, the computer will be used to automatically command the extensible links without collisions, transparent to human operators. The basket is controlled in Cartesian space, with three translations, X, Y, Z, and three rotations, Pitch, Roll, and Yaw, as shown. These motions may be performed separately or in combinations. For human workers, however, the basket must remain horizontal for all motions. Therefore, the basket will be horizontal at the start and the Roll and Pitch angle motion will be disabled by the computer. A passive gimbal system driven by gravity can also be used to ensure a horizontal basket. A second type of active scaffolding of the present invention may be used for carrying inspection cameras and other remote sensors to sites without humans. This system could utilize the Roll and Pitch motions. This embodiment would be lighter and the challenge of design for human safety would be lessened. However, the focus of the present invention is the human-transporting active scaffolding system. The present invention may also be adapted with little effort to unmanned structural systems.

There are widely varying potential applications for the active scaffolding system of the present invention. Different customers would require significantly different specifications. Therefore, the present invention thus is a general, computer-based, integrated design tool to satisfy many needs. To simultaneously achieve a stiff, lightweight, safe structural system with a large motion range requires integration of kinematics, dynamics, structural optimization, and control algorithms. If the potential of variable geometry trusses is to be realized, the motion range must be large, the weight must be relatively low, and the stiffness high. Clearly, the present invention may achieve this goal, accommodating competing constraints, to achieve an active modular scaffolding system.

The following discusses kenematics and dynamics modeling, structural optimization and control algorithm development.

Kinematics and Dynamics Modeling

Figure 1:
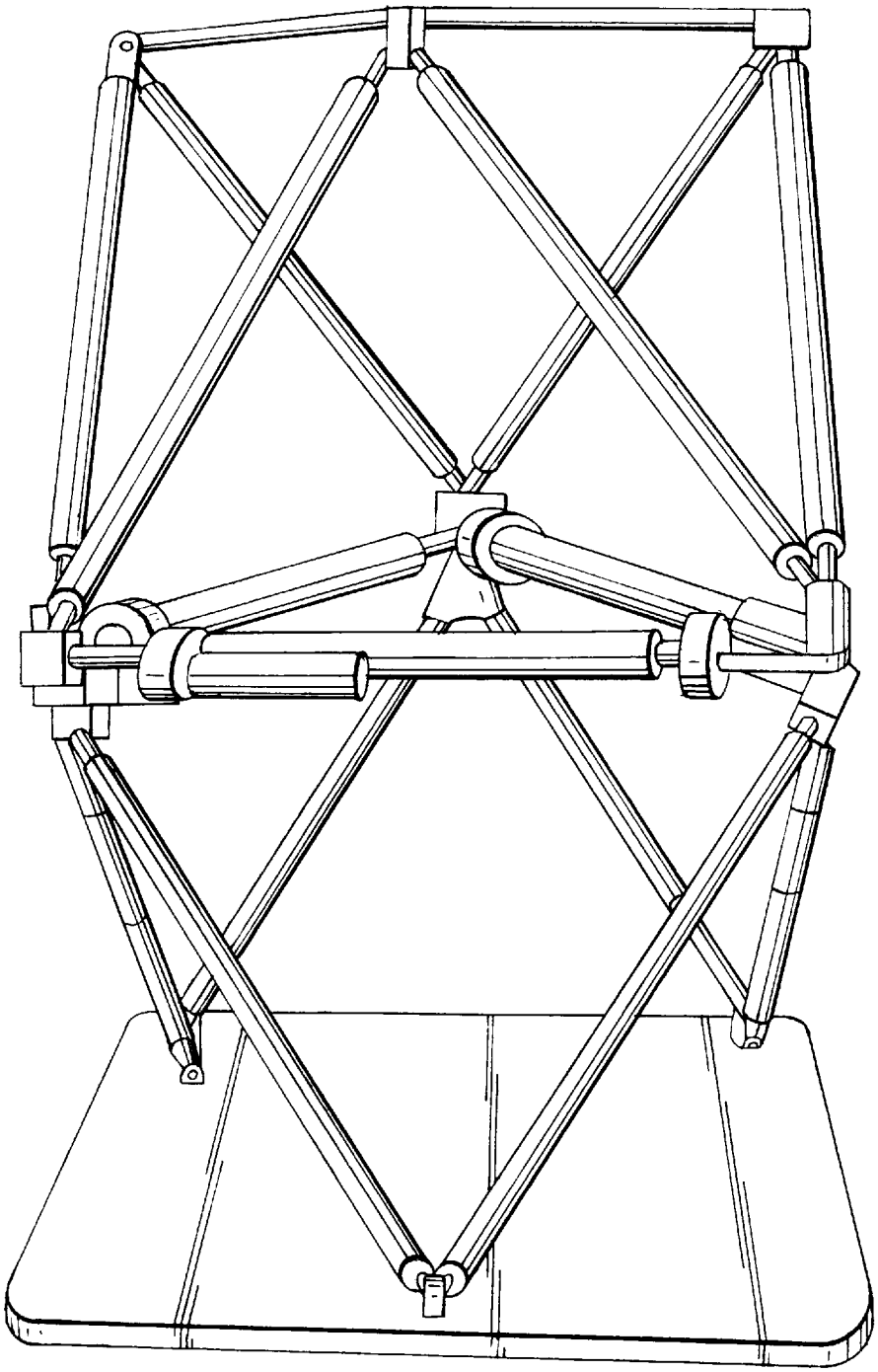
FIG. 1 shows a double octahedral VGT.

The first step in kinematics modeling is to determine feasible modules for the active scaffolding. This has largely been completed, as set forth in Williams, R. L., II, "Survey of Active Truss Modules", *ASME Design Technical Conferences,* Boston, Mass., September, 1995, hereby incorporated herein by reference. The three modules which will be considered are the VGT, LAM, and BAM modules (FIGS. 1, 6, and 7). New modules maybe developed if warranted. Kinematics equations may be developed for each candidate module, relating the variable strut lengths to the motion output. This is a straightforward application of kinematics for the planar LAM and BAM modules. It is more difficult for the spatial VGT module, but that analysis has been completed by the and may be found in Williams, R. L., II, "Kinematic Modeling of a Double Octahedral Variable Geometry Truss (VGT) as an Extensible Gimbal", *NASA Technical Memorandum* 109127, NASA Langley Research Center, Hampton, Va., 1994, hereby incorporated herein by reference.

Kinematic constraints relating the module range of motion to the module dimensions (including the variable strut length limits) must be developed. Again, this is straight-forward for LAM and BAM modules, and reported for the VGT in Williams, R. L., II, "Kinematic Modeling of a Double Octahedral Variable Geometry Truss (VGT) as an Extensible Gimbal", *NASA Technical Memorandum* 109127, NASA Langley Research Center, Hampton, Va., 1994, hereby incorporated herein by reference.

Figure 5B:
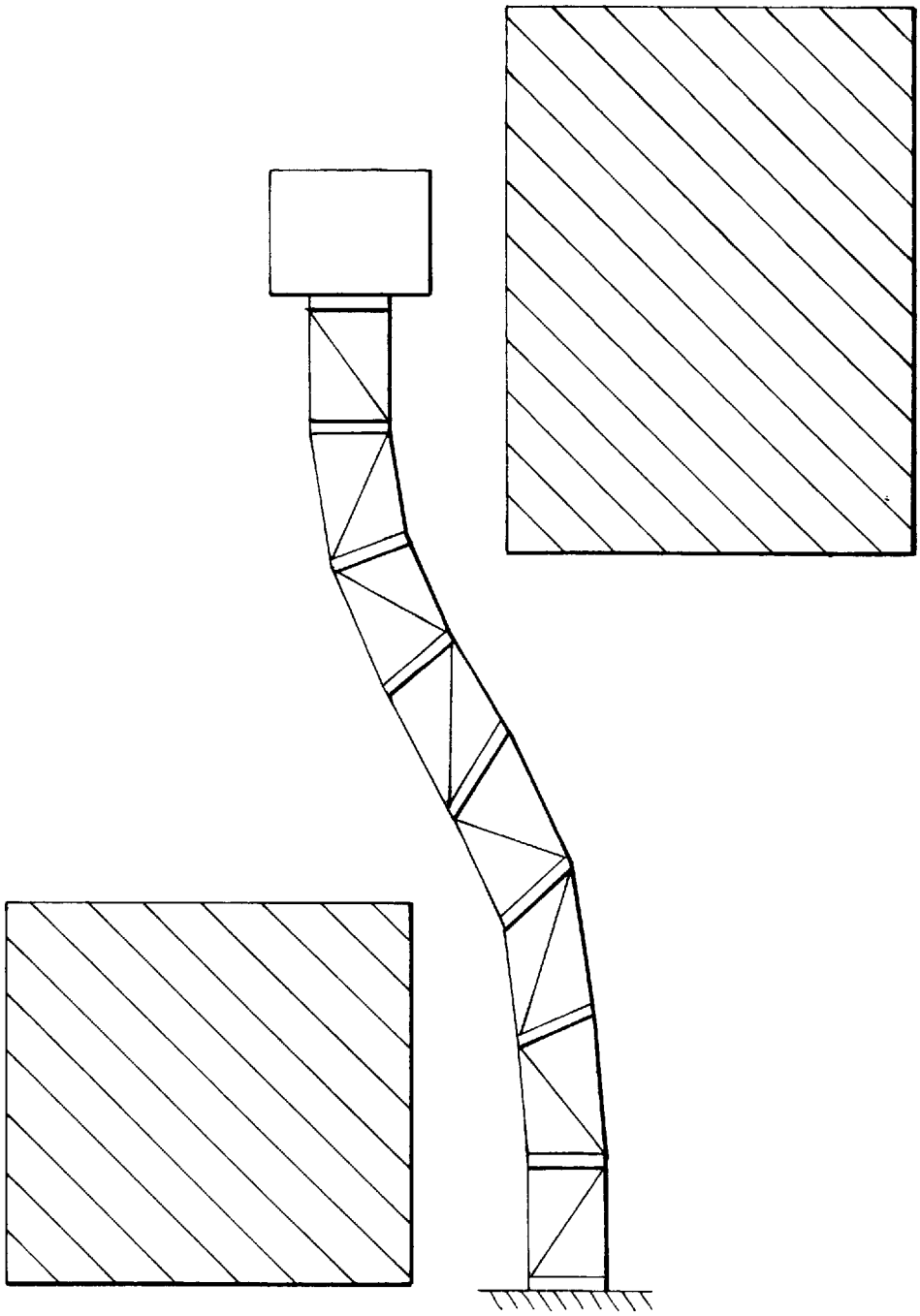
FIG. 5*b* shows the active scaffolding of the present invention in deployed position.

In order to obtain a dexterous active scaffolding system, active modules must be combined in a serial fashion (see FIG. 5*b*). For spatial operation, the planar modules can be arranged in perpendicular planes. The active structure must have a minimum of six degrees-of-freedom (dof) for general operation in Cartesian space (see FIG. 8). However, it is proposed that the active scaffolding possess high kinematically-redundant degrees-of-freedom so obstacle avoidance and other performance optimization may be achieved in addition to basic Cartesian trajectories. For instance, the active structure in FIG. 5 has 30-dof if constructed of the module in FIG. 6, and 11-dof if constructed of the module in FIG. 7.

The biggest challenge in kinematics modeling is development of the kinematic equations for Cartesian control of the overall active scaffolding system. That is, either automatic or joystick control inputs should be in the Cartesian space, shown in FIG. 8. These commands must be automatically transformed by computer into extension or retraction commands for each active strut. A novel method for this transformation has been developed, with preliminary results as set forth in Williams, R. L., II, and Mayhew, J. B., IV, "Coordination of Modular Truss-Based Manipulators: The Virtual Serial Manipulator Approach", submitted to the 1996 *ASME Mechanisms Conference,* Irvine, Calif., August, 1996, hereby incorporated herein by reference. This Virtual Serial Manipulator Approach is summarized below.

The Virtual Serial Manipulator Approach models a modular, strut-actuated active scaffolding as a virtual serial manipulator which provides kinematically-equivalent motion. For instance, the virtual serial model for the active structure module of FIG. 6 is shown in FIG. 10.

The method automatically resolves Cartesian end point translational and rotational velocities to strut extension rates. Both automatic trajectory and joystick modes can command either velocities or positions. If positions are commanded, a difference between the commanded and current positions forms the command input k. The basic kinematics equation for trajectory following and simultaneous performance optimization is adapted from standard control algorithms for kinematically-redundant serial manipulators as set forth in Williams, R. L., II, and Mayhew, J. B., IV, "Coordination of Modular Truss-Based Manipulators: The Virtual Serial Manipulator Approach", submitted to the 1996 *ASME Mechanisms Conference,* Irvine, Calif., August, 1996, hereby incorporated herein by reference.

The virtual joint rates $\dot{\underline{\Phi}}$ are composed of the particular solution $J^{+}_{v}X$ to achieve the Cartesian trajectory and the homogeneous solution $(I-J^{+}_{v}J_{v})_2$ to accomplish performance optimization, such as obstacle avoidance as set forth in Williams, R. L., II, "Real-Time Control of a Redundant Eight-Degree-of-Freedom Manipulator with Performance Optimization", submitted to the *Journal of Mechanical Design,* March, 1995 hereby incorporated herein by reference. The virtual serial manipulator Jacobian matrix Jv is easier to determine symbolically than the Jacobian matrix of the active scaffolding, but it provides the same motion for the end point. The pseudoinverse $J^{+}_{v}$ of the virtual Jacobian matrix must be used for inversion because the Jacobian matrix is underconstrained (more columns than rows). The virtual joint rates $\dot{\underline{\Phi}}$ are integrated to virtual joint positions $\underline{\Phi}$. The vector $\underline{\Phi}$ cannot be commanded to the active structure, so a transformation from virtual serial joint positions $\underline{\Phi}$ to variable actuator lengths is required. The in-parallel-actuated complexity is isolated module by module, which is significantly easier (conceptually and computationally) than treating the entire active scaffolding in a parallel sense.

Figure 11A:
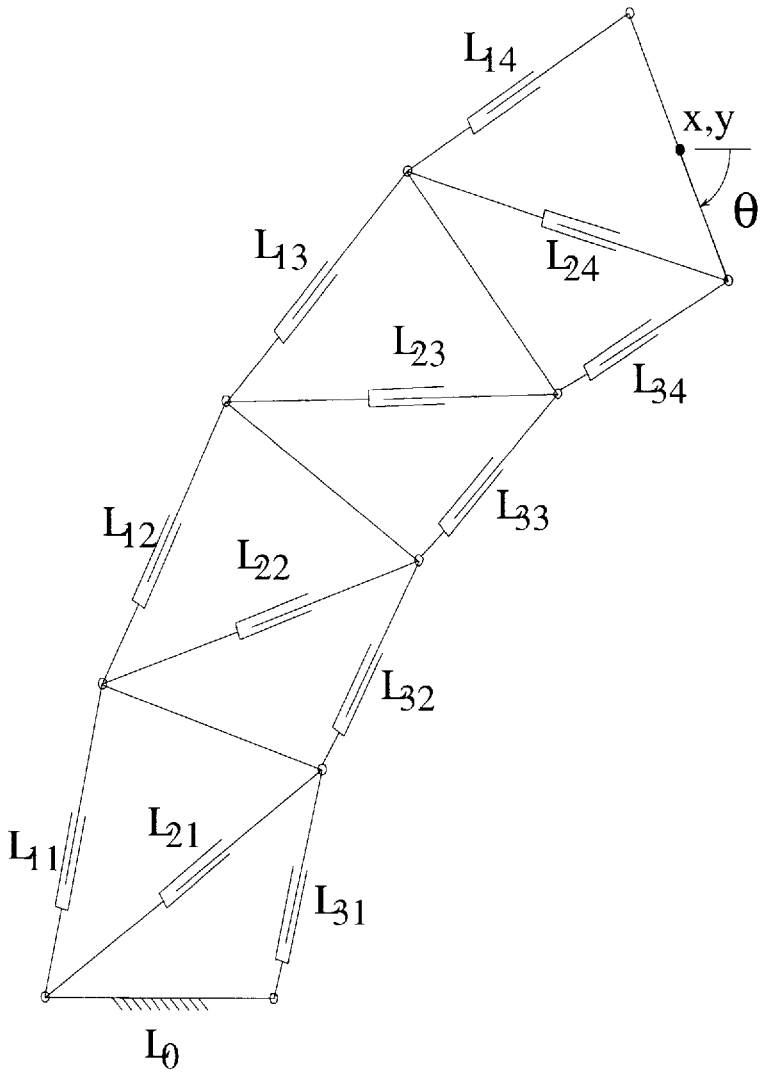
FIG. 11*a* shows novel Cartesian coordination algorithm implemented for a 12-dof active structure composed of four FIG. 6 modules.
Figure 11B:
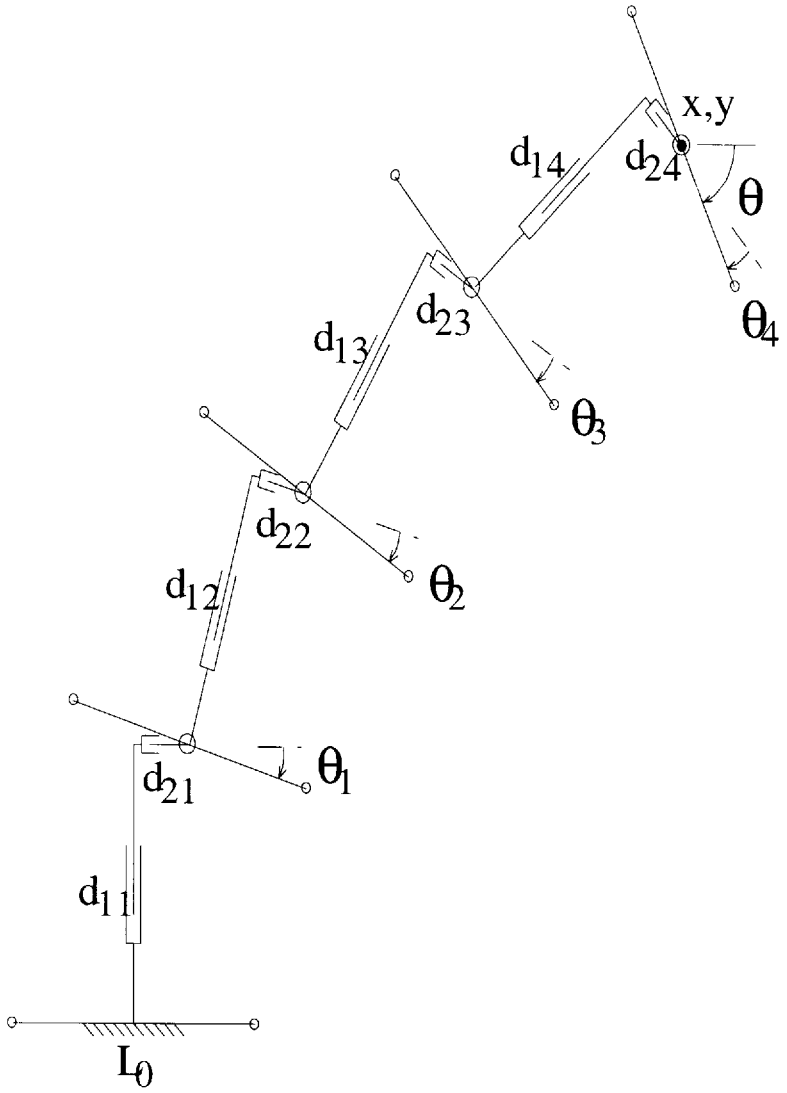
FIG. 11*b* shows the virtual serial model of the device shown in FIG. 11*a*.

This novel Cartesian coordination algorithm was implemented for a 12-dof active structure composed of four FIG. 6 modules, shown in FIG. 11*a*. The virtual serial model for this device is given in FIG. 11*b*. MATLAB software was used to graphically simulate the active structure motion under the novel algorithm.

The present invention may use a follow-the-leader algorithm as set forth in Williams, R. L., II, "Follow-the-Leader Algorithm for Hyper-Redundant Serpentine Manipulators", submitted to the *Journal of Mechanical Design,* September, 1995, hereby incorporated herein by reference, for obstacle-free motion of an 18-dof trussbased active structure. This device may be used to carry a camera through the cluttered and sensitive Space Shuttle payload bay for prelaunch safety inspections. This work is directly applicable to the active scaffolding concept of the present invention.

Dynamics modeling involves relating the active and rigid strut forces to the active structure motion (accelerations). This area is important in sizing the actuators, including type of actuator and the dynamic response required, and determining the system power requirement. Newton-Euler or Lagrangian modeling may be applied to derive the dynamic equations of motion for the dynamic constraints in the integrated design tool. Either modeling technique yields the following form of the equations of motion:

$$F=M(L)L+V(L,\ L)+G(L) \tag{2}$$

where F is the vector of linear actuator forces; M(L) is the active structure inertia matrix, a function of the actuator extensions L, $\dot{L}$, $\ddot{L}$ are the linear actuator velocity and acceleration; V(L, L) is the vector of centrifugal and Coriolis terms, and G(L) is the vector of gravity terms. Equation 2 is used in two ways: 1) Given the active structure motion L, $\dot{L}$, $\ddot{L}$, to determine the required actuator forces, F, and 2) Given F, integrate the equations of motion to calculate the motion, used for simulation of the active structure.

A potential dynamics problem is unwanted vibration of the active structure during or after motion. The governing equation for this problem is:

$$F=M(L)\ddot{X}+C(L)\dot{X}+K(L)X \tag{3}$$

where F is the total loading vector; M, C, and K are the mass, damping, and stiffness matrices, each functions of the actuator extensions L; and X, $\dot{X}$, $\ddot{X}$ are the Cartesian translational and rotational displacements, velocities, and accelerations of the coordinate frame of interest. Given F, the vibratory motion X, $\dot{X}$, $\ddot{X}$ is calculated by integrating Eq. 3. A related problem is unwanted vibration of the active structure due to forces and moments at the basket due to the human workers contact with the environment. Admittance modeling (in a form similar to Eq. 3) can be used to derive models of the structure for use 'm vibration rejection algorithms.

It is envisioned that dynamics will not present a problem to the active scaffolding system due to low operating speeds and accelerations. With that condition, the loading due to gravity will dominate. However, dynamics modeling must be performed to ensure this assumption is correct, and as a integral component of the general design tool.

Structural Optimization

The present invention thus provides the active scaffolding structure in an optimized manner. Given the tip mass of the basket including humans, equipment, and materials, the structural optimization problem is stated: Minimize the active structure mass subject to $$P_{MIN} \leqq {}^{0}P_{N} \leqq P_{MAX}$$

$$\underline{\Phi}_{i} \geqq \underline{\Phi}_{iMIN}$$

$$V_{tip} = V_{MAX}\ A_{tip} = A_{MAX}$$

$$F_{i} \leqq F_{iMAX}$$

$$\perp\!\!\perp\ \underline{\Delta}_{tip}\ \perp\!\!\perp \leqq \underline{\epsilon}$$

Equation 4 enforces the required Cartesian range of motion for the translational vector of the basket ${}^{0}P_{N}$; Equation 5 forces each module kinematic range larger than the given minimum; Equation 6 says that the design will be performed for the worst motion case, with maximum tip velocity and acceleration; Equations 7 and 8 are dynamics constraints, maintaining the actuator forces and the unwanted tip deflections below the given maximum values. An automatic algorithm may be used to modify the structural design to find the optimum among these competing constraints. The finite element method will be called at each iteration in order to calculate the loading in each strut.

This aspect of the present invention must also consider the structural design, including material choices, and actuator and joint design. The structure should be designed so all loading is in tension and compression of the struts. Buckling is an important failure condition to check. Both static and dynamic loading must be considered. Another critical issue is the resistance of a large base moment due to the tip mass acting through a large moment arm. This moment may be resisted via mounting the structure to a rigid base. The active scaffolding concept is modular; however, for structural efficiency, a tapered modularity will be allowed. That is, the modules will be kinematically similar, but the base modules may be larger to resist the higher loading. Modules can taper towards the tip due to lower loading.

Standard global non-linear optimization techniques will be applied where possible. If warranted, more innovative techniques such as simulated annealing or genetic algorithms will be used.

Control Algorithm Development

The active scaffolding system will be controlled in automatic and joystick modes, discussed previously. The novel Virtual Serial Manipulator Approach summarized in the proposed controller framework:. FIG. 12 shows the controller.

Equation I is used to calculate the virtual serial manipulator joint rates $\dot{\underline{\Phi}}$ given the Cartesian trajectory $\dot{X}$ and the performance optimization vector z. For instance, z can be used to avoid obstacles as set forth in Williams, R. L., II, "Real-Time Control of a Redundant Eight-Degree-of-Freedom Manipulator with Performance Optimization", submitted to the *Journal of Mechanical Design,* March, 1995 hereby incorporated herein by reference. The virtual rates are integrated to virtual positions $\underline{\Phi}$. The virtual joint positions are transformed to real strut commands L via Module Inverse Kinematics. This completes the coordination of Cartesian motion to joint commands. The remaining block in FIG. 12 sends the strut length commands to the hardware controller, where PID feedback control is used to continuously achieve the commanded lengths.

This proposed controller was implemented (for one module) on the hardware of FIG. 1 at NASA Langley Research Center. It proved to be an effective scheme to coordinate the desired Cartesian motion with computer-calculated strut commands.

Development of Integrated Design Tool

This present invention assembles the separate kinematics, dynamics, structural optimization, and control aspects into an integrated, computer-based design tool. The goal is to run the algorithms in a seamless manner, with minimal intervention from the human designer.

The design tool will accommodate various system requirements, because the potential applications are varied. The input will be according to operator specifications and designs, in terms of range of motion, payload, deflection, tip velocities and accelerations, and environment characteristics. The output may be an optimized design for an active scaffolding system which can be controlled to achieve the desired performance.

Other Industrial Applications

The nuclear power industry uses static scaffolding during power outages for routine maintenance in the cluttered and radioactive power plant environment. More human exposure to radiation is incurred in the building of scaffoldings than in the actual work performed from the scaffoldings. Therefore, an active scaffolding system of the present invention can build itself and save human exposure to radiation.

The present invention will enable efficient, optimized, computer-based design of active modular scaffolding systems. There are numerous potential applications for such dexterous human lifts, from industrial and home construction and maintenance, to active bridges, antennae, and other structures.

What is claimed is:

1. An active scaffolding system adapted to hold a payload, said active scaffolding system comprising:

(a) a plurality of adjustable links and rigid links connected by joints;

(b) a plurality of actuator devices associated with the adjustable links so as to change to length of the adjustable links;

(c) a microprocessor to determine how the lengths of each of the adjustable links throughout a number of time steps; the said microprocessor being provided with computer program instructions to resolve Cartesian end point translational and rotational motions;

(d) the said adjustable links, rigid links, and actuator devices forming an active scaffolding adapted to move a payload around environmental obstacles while supporting said payload against the force of gravity.

* * * * *

UNITED STATES PATENT AND TRADEMARK OFFICE

CERTIFICATE OF CORRECTION

PATENT NO. : 5,803,203
DATED : September 8, 1998
INVENTOR(S) : Robert L. Williams, II It is certified that error appears in the above-identified patent and that said Letters Patent is hereby corrected as shown below:

In column 3, line 4, after the word "retracted" please insert the word -- in --.

Figure 10A:
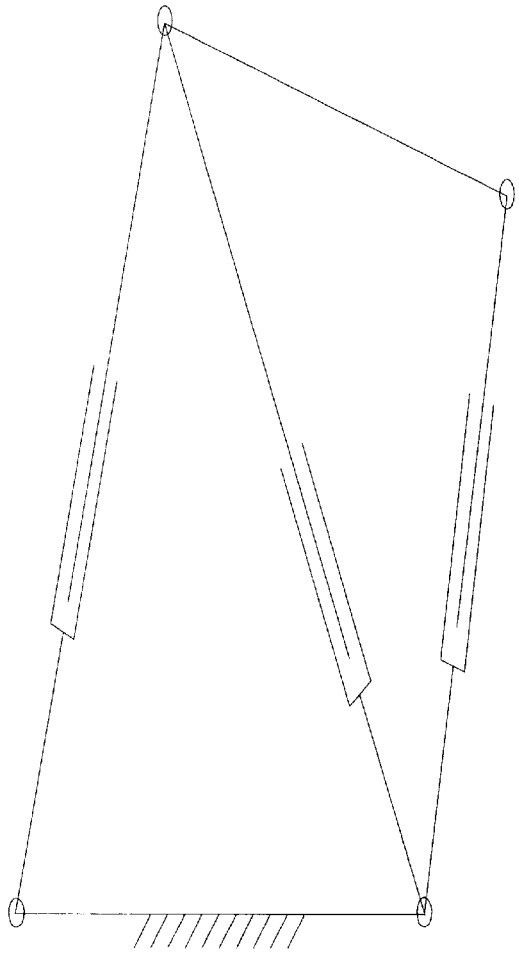
FIGS. 10*a* and 10*b* show virtual serial model for the active structure module of FIG. 6.
Figure 10B:
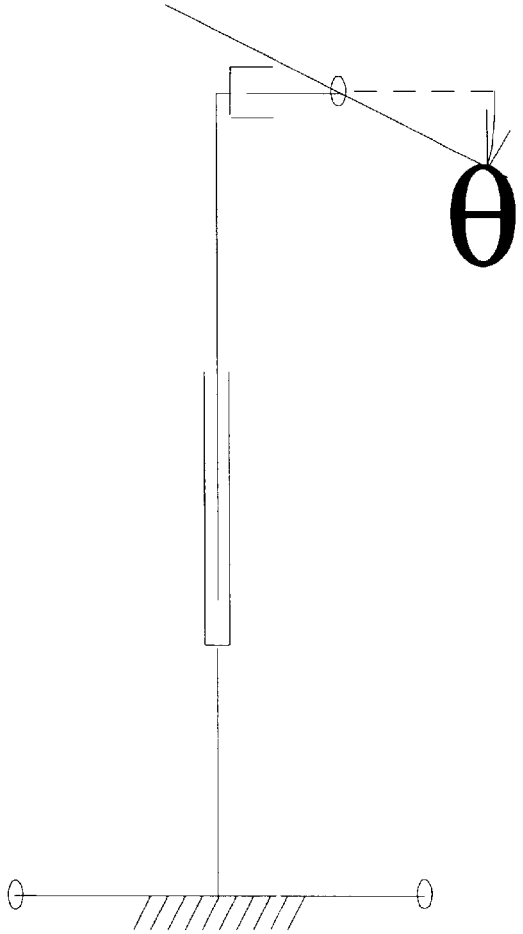

In column 4, line 51, please delete the words "FIG. 10" and replace it with -- FIGS. 10a and 10b --.

Signed and Sealed this

Eleventh Day of May, 1999

*Attest:*

Q. TODD DICKINSON

*Attesting Officer*

*Acting Commissioner of Patents and Trademarks*